United States Patent [19]

Clough

[11] Patent Number: 4,711,083

[45] Date of Patent: Dec. 8, 1987

[54] FRICTION SPINNING APPARATUS

[75] Inventor: Douglas O. Clough, Rossendale, England

[73] Assignee: Hollingsworth UK, Ltd., Accrington, England

[21] Appl. No.: 882,322

[22] Filed: Jul. 7, 1986

[30] Foreign Application Priority Data

Nov. 22, 1985 [GB] United Kingdom ..... 8528845

[51] Int. Cl.[4] ..... D01H 7/885

[52] U.S. Cl. ..... 57/301; 57/401

[58] Field of Search ..... 57/263, 301, 304, 400, 57/401, 405, 411

[56] References Cited

U.S. PATENT DOCUMENTS 4,514,972 5/1985 Stahlecker ..... 57/301

4,570,434 2/1986 Stahlecker ..... 57/401

4,586,325 5/1986 Wassenhoven ..... 57/301 X 4,671,792 10/1986 Stahlecker ..... 57/304 X

*Primary Examiner*—Donald Watkins

*Attorney, Agent, or Firm*—Cort Flint

[57] ABSTRACT

A friction spinning unit includes a pair of cylindrical friction spinning rollers of which one has an air nozzle mounted adjacent to its periphery and able to discharge a current of air along the surface of that roller so as to move any unwanted fibres which may be on the surface of said roller. The air jet from the nozzle may provide a pneumatic barrier to hold fibres away from an annular passage between a surrounding shroud and the outer foraminous sleeve of the foraminous roller, and/or the air jet may be used to clear a fibrous slub from the spinning nip in the event of such a slub forming after a yarn break.

8 Claims, 2 Drawing Figures

FRICTION SPINNING APPARATUS

FIELD OF THE INVENTION

The present invention relates to a friction spinning apparatus comprising two parallel, closely arranged cylindrical rollers defining a spinning nip into which fibres are introduced to be rolled up to form a yarn.

PRIOR ART

The conventional friction spinning apparatus of such a type has a suction slot within one or both of the spinning rollers, providing localised suction so as to concentrate the fibres at the nip. However, some fibres may escape this suction effect and, because of the localisation of the suction, may then be able to lodge in other parts of the friction spinning unit. For example, one time when fibres may well cause difficulties in the friction spinning unit is after a yarn break when the slub resulting from a short over feed of fibres following the breaking of the yarn results in the fact that these fibres are unable to be removed from the spinning nip and become rolled up to form a slub which needs to be removed before the yarn can be re-pieced.

OBJECT OF THE INVENTION

It is an object of the invention to provide a means of preventing problems through fibres remaining in the spinning unit, either during or after operation.

SUMMARY OF THE INVENTION

According to the present invention we propose to generate an airstream which will move any undesirable fibres in the nip along the line of the nip towards one end.

Preferably, means for collecting the moved fibres are arranged at said one end, and the fibre-collecting means may for example comprise a port open to a source of suction when fibre removal is required.

BRIEF DESCRIPTION OF THE DRAWING

In order that the present invention may more readily be understood the following description is given, merely by way of example, with reference to the accompanying drawing in which.

DESCRIPTION OF THE PREFERRED EMBODIMENT

Figure 1:
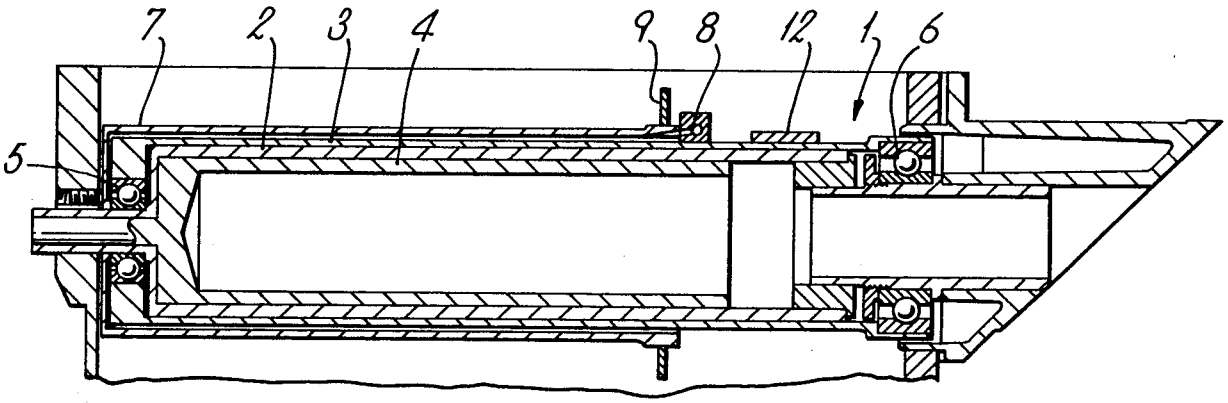
FIG. 1 is a longitudinal sectional view of one of the two friction spinning rollers of a single friction spinning unit in accordance with the present invention.

In this particular friction spinning unit, which may be one of several such units in a multi-position friction spinning machine, one (1) of the rollers is foraminous and the other is imperforate. However, the principles of the invention could if desired be applied to a friction spinning unit having both of the rollers foraminous.

The foraminous roller 1 comprises an inner sleeve 2 defining a suction slot within a foraminous outer sleeve 3, so that the slit in the inner sleeve 2 localises the suction to the nip.

A further sleeve 4 includes a parallelogram-shaped slot which is used during piecing, as disclosed in our No. EP-A-0 052 412.

In normal use of the friction spinning unit, the foraminous outer sleeve 3 rotates at high speed by virtue of the end bearings 5 and 6 and by virtue of a tangential belt drive riding on the periphery of the sleeve 3, while the slotted inner sleeves 2 and 4 are stationary.

The position of the slot in the sleeve 2 can if desired be adjusted, for example for the purposes of tuning the friction spinning unit for a particular staple fibre material being spun; the inner sleeve 4 is rotated only during the shut-down and piecing operations.

Around the foraminous outer sleeve 3 is, in this case, a further sleeve 7 serving as a shroud of the perforated roller and spaced from the sleeve 3 to define therewith a narrow passage extending circumferentially around the foraminous roller assembly 1.

At one end of the annular passage defined between the shroud 7, and the foraminous outer sleeve 3 of that perforated roller 1, is an air jet nozzle 8 positioned alongside the holding plate 9 for the shroud 7. The nozzle 8 projects air into the annular passage between the shroud 7 and the foraminous outer sleeve 3, with a component of movement along the foraminous roller assembly 1.

Figure 2:
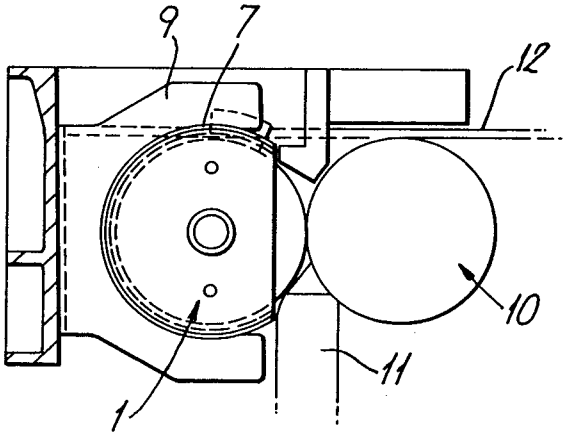
FIG. 2 is a partly sectioned end view showing the friction spinning unit of FIG. 1.

In this particular case the movement of the air from the nozzle 8 is helically around the axis of the foraminous roller assembly 1, but in such a way that the airflow is directed in a clockwise sense around the foraminous roller assembly 1 as viewed in FIG. 2 and hence the effect of the air jet is to blow the fibrous slub, which may remain in the friction spinning unit upon shutdown, in a direction axially along the spinning nip. Thus, upon shut-down, the air jet can be activated to clear the chamber, and the strength of the air jet released from nozzle 8 can be sufficient to expel the slub along the nip even while suction to the interior of the slotted sleeves 2 and 4 is applied. However, it is alternatively possible for the suction to be switched off during pneumatic cleaning by the nozzle 8.

At one end of the two friction spinning rollers 1 and 10, i.e. the left hand end as viewed in FIG. 1, there may be a receptacle (not shown) to receive the fibrous slub released by the jet issuing from the nozzle 8 during the cleaning operation. Alternatively, in the case of a manually cleaned spinning unit, the slub may be allowed to be discharged forwardly of the apparatus when the unit is opened. The friction spinning unit illustrated in FIGS. 1 and 2 will be as disclosed in our No. EP-A-0 052 412 in that the imperforate roller 10 is lifted clear of the fibre feed duct 11 and the foraminous roller assembly 1 when the spinning unit is opened for cleaning and re-piecing. Hence the operation of the air jet at this time will be capable of expelling the fibrous slub clear of the friction spinning rollers if no separate slub receptacle is required.

Any such slub receptacle may of course be subject to vacuum as disclosed in our No. EP-A-85307591.9.

FIG. 2 also shows the imperforate friction spinning roller 10 and the fibre feed duct 11 which feeds staple fibres to the nip for spinning purposes.

In this particular case, where the friction spinning unit includes the outer shroud 7, it is interesting to note that the operation of the air jet 8 serves to provide a pneumatic barrier preventing stray fibres from entering the space between the shroud 7 and the foraminous outer sleeve 3 during cleaning. Hence the likelihood of individual fibres being carried into and trapped within the annular passage between the shroud and the outer foraminous sleeve still rotating during the cleaning operation after a yarn break is considerably reduced and in this way the likelihood that, during prolonged use of the spinning unit, fibre will build-up on a nucleus provided by such a trapped fibre eventually causing jamming of the annular passage between the shroud and the foraminous outer sleeve is removed.

In order to provide this "pneumatic barrier" function, the nozzle 8 is switched to discharge an air jet during the cleaning operation of the friction spinning unit, for example as the spinning unit is opened in the case of a manually cleaned unit.

FIG. 2 shows that the shroud 7 extends around the major part of the foraminous roller assembly but is open at the front (underside) and the rear (top side) of the nip between the rollers 1 and 10.

Although, in the above description, we refer to manual cleaning of the friction spinning unit, it is equally possible to incorporate the air jet in a multiposition friction spinning apparatus where the units are each cleaned by a servicing robot travelling along the machine. The air nozzle may in that case be carried by the robot itself, if desired, and there will be no need for the roller 10 to be moved away for cleaning.

I claim:

1. Friction spinning apparatus including:

(a) a pair of parallel adjacently arranged first and second friction spinning rollers;

(b) means driving said first and second friction spinning rollers in the same sense and defining a spinning nip;

(c) means for feeding fibres to said spinning nip;

(d) an air discharge nozzle directed to discharge air at the periphery of said first friction spinning roller with a first component of movement along, and close to, the surface of at least said first friction spinning roller, and a second component of movement circumferentially around the said first friction spinning roller, for urging unwanted fibres along the nip towards one end thereof;

(e) a cylindrical shroud closely surrounding said first friction spinning roller; and (f) means defining an annular clearance defined between said shroud and said first friction spinning roller; said air-discharging nozzle being arranged to discharge a jet of air into said annular clearance with said second component of movement opposed to the direction of movement of said first friction spinning roller in use of the spinning apparatus.

2. Friction spinning apparatus according to claim 1, wherein said shroud surrounds said first friction spinning roller over at least 270° of arc thereof and along a major part of the length thereof.

3. Friction spinning apparatus according to claim 1 and including means adjacent one end of the first and second friction spinning rollers for collecting a slub released by said air jet.

4. Friction spinning apparatus according to claim 1, wherein said air-discharging nozzle is adapted to be operated only during piecing of the friction spinning apparatus.

5. Friction spinning apparatus according to claim 1, wherein said air-discharging nozzle is effective only during piecing of the friction spinning apparatus and provides a pneumatic barrier preventing stray fibres from entering said annular space between said cylindrical shroud and the said first friction spinning roller which it surrounds.

6. Friction spinning apparatus according to claim 5, wherein said air-discharging nozzle is effective to provide a pneumatic barrier to prevent fibres from leaving the back of the friction spinning nip after they have been introduced to the front of the nip by said fibre feed means.

7. A method of operating friction spinning apparatus having two closely spaced first and second cylindrical friction spinning rollers having parallel first and second axes of rotation respectively, and defining a nip to which separated fibres are fed to be rolled up into a yarn, such method comprising the step of injecting air along the surface of said first friction spinning roller with a component of movement parallel to said first and second parallel axes of rotation, so as to displace a fibrous slub which may form in the event of a yarn break.

8. A method of operating friction spinning apparatus comprising two closely spaced first and second cylindrical friction spinning rollers defining a nip to which separated fibres are fed to be rolled up into a yarn, and baffle means closely surrounding at least said first friction spinning roller, including the step of discharging an air jet along the surface of said first friction spinning roller between said first friction spinning roller and said baffle means during cleaning after a yarn break to provide a pneumatic barrier to prevent loosened fibres from being carried on the surface of said first friction spinning roller in a direction away from the nip.

* * * * *